United States Patent [19]

Carfagno

[11] 3,968,988

[45] July 13, 1976

[54] SAFETY LATCH

[75] Inventor: Angelo J. Carfagno, Philadelphia, Pa.

[73] Assignee: L. H. Shingle Company, Plymouth Meeting, Pa.

[22] Filed: Feb. 15, 1973

[21] Appl. No.: 332,891

[52] U.S. Cl. ..... 294/82 R; 24/241 P

[51] Int. Cl.[2] ..... B66C 1/36

[58] Field of Search ..... 294/82 R, 83 R; 24/241 R, 241 CH, 241 P, 241 PP, 241 PL, 241 TC, 241 SB

[56] References Cited

FOREIGN PATENTS OR APPLICATIONS 1,032,584 6/1966 United Kingdom ..... 294/82 R

*Primary Examiner*—Johnny D. Cherry

*Attorney, Agent, or Firm*—Paul & Paul

[57] ABSTRACT

An improved safety latch for industrial load hooks to prevent slippage from rings or trolleys or other hooks.

1 Claim, 7 Drawing Figures

SAFETY LATCH

BACKGROUND OF THE INVENTION

This invention relates to safety latches that prevent slippage from industrial load hooks, particularly those load hooks of a generally question-mark shape.

The present device is an improved safety latch of the type used to prevent slippage of load hooks from such things as overhead rings or trolleys. Previous devices had significant drawbacks. In the latch member, the finger lugs were awkwardly shaped, difficult to grasp, and provided a projecting edge upon which articles of clothing might be snagged. Also, there was a tendency for the latch member to slide laterally across the inside edge of the load hook. The clamp member was normally made from cast metal and was subject to all the inherent deficiencies of castings. Also, previous clamp members did not have the shank portion curved to fit the load hook. Nor was the shank portion integral with the main ring of the clamp member, which resulted in a weaker structure and early failure.

SUMMARY OF THE INVENTION

The disadvantages of prior art devices have been corrected in the present invention. The finger lugs of the latch member have been trimmed and chamfered somewhat in order to reduce sharp edges. The center of the bottom outer surface of the latch member has been provided with a "dimple", a deeply pronounced indentation, so that now the latch member is securely positioned against the inner surface of the load hook, no longer being subject to lateral movement. The clamp member of the present invention is formed from a single, integral piece of stamped steel, and then bent into shape, thus avoiding the inherent weakness of castings. Since the shank portion of the clamp member is integral with the main ring of the clamp member, it now need not have an excessive amount of material present in order to give structural strength. Because of this, the center line of the hinge portion can now be positioned inboard i.e., closer towards the center of the ring, of the inner circumference of the ring portion of the clamp member. This places the entire safety latch closer to the hook, thus enlarging the effective throat opening of the load hook with the safety latch in place. This gives a more durable, long-lasting safety latch.

It is an object of this invention to provide an improved latch member for safety latches for use on industrial load hooks.

It is an object of this invention to provide an improved clamp member for safety latches for use on industrial load hooks.

It is an object of this invention to provide an improved safety latch for industrial load hooks.

DESCRIPTION OF THE PREFERRED EMBODIMENT

Figure 1:
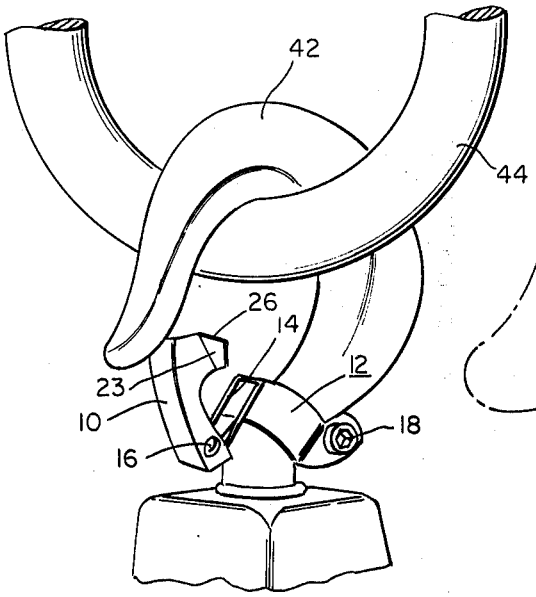
FIG. 1 is a perspective view of the safety latch in use attached to a typical industrial load hook.
Figure 2:
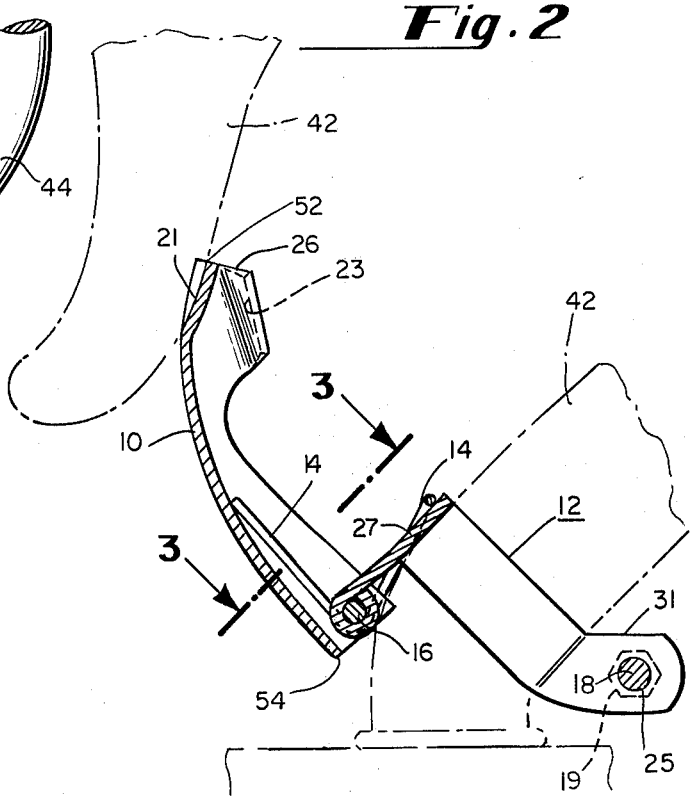
FIG. 2 is an enlarged side view of the safety latch of FIG. 1, with the hook shown in phantom and the latch member and the shank portion of the clamp member shown in partial cross-section.
Figure 3:
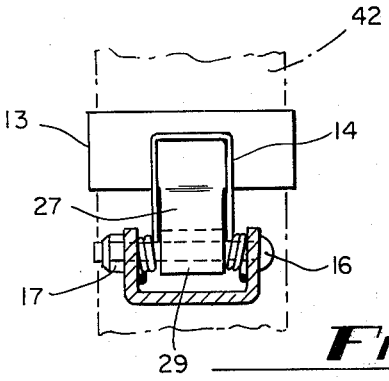
FIG. 3 is a sectional view looking in the direction of the arrows of FIG. 2, showing the placement of the spring in relation to the clamp and latch members.
Figure 5:
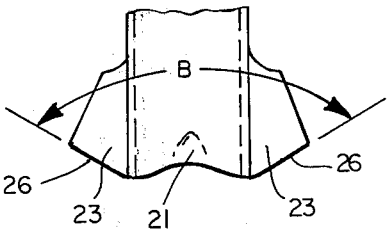
FIG. 5 is a fragmentary front view of the bottom outer surface of the latch member, showing both the dimple and the obtuse included angle defined by the trimmed edges of the finger lugs.
Figure 4:
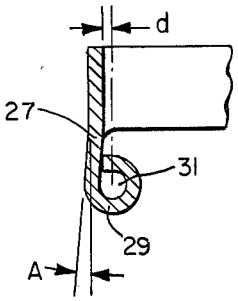
FIG. 4 is a cross-section of the shank portion of the present invention, showing both the inboard positioning of the hinge centerline and the outward inclination of the shank portion of the clamp member.
Figure 6:
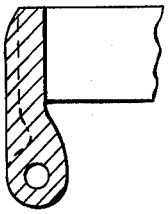
PRIOR ART Fig. 6
FIG. 6 is a cross-section of the shank portion of a device of the prior art which was made from a casting.
Figure 7:
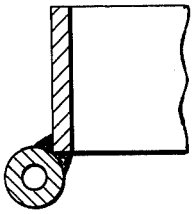
PRIOR ART Fig. 7
FIG. 7 is a cross-section of the shank portion of another device of the prior art, having a drilled rod welded to the edge of a steel band.

Referring to the figures, a latch member 10 is joined to a clamp member 12 by means of a latch screw 16 and latch screw nut 17 through hinge portion 29 of clamp member 12. Wrapped about hinge screw 16 is latch spring 14 which rests against ring portion 13 of clamp member 12 (shown in FIG. 4), tending to force latch member 10 away from clamp member 12. In FIGS. 1 and 2, clamp member 12 is shown secured to load hook 42 which rests upon ring 44. Clamp member 12 is held in place wrapped about hook 42 by means of clamp bolt 18 and clamp bolt nut 19, through bolt holes 25 of the ends 31 of ring portion 13 of clamp member 12. Latch member 10 has finger lugs 23 which permit safe opening of the safety latch with either hand. These finger lugs in the present invention have their lower edges 26 chamfered or trimmed to avoid excess material which may snag clothing. Latch member 10 also has a positioning "dimple" 21, a deep indentation, which secures hook-engaging end 52 of latch member 10 laterally to the inside surface of hook 42 at the throat opening of hook 42. Clamp member 10, as shown in FIG. 2, is positioned close to the throat opening of the hook, rather than "interiorly" ("interiorly" meaning toward the bottom of the hook in a direction perpendicular to the shortest distance across the throat opening) of the throat opening. Previous devices of this type either had nothing, or at best an inadequate small depression which did not restrain lateral movement against a hook surface sufficiently. Latch spring 14 is preferably made from stainless steel. The trimmed edges 23 of latch member 10, as shown in FIG. 5, define an included angle B that is substantially obtuse (i.e. between 90° and 180°) and preferably about 145°, therebetween (as shown in FIG. 5).

Both latch member 10 and clamp member 12 are preferably made from steel stampings bent to shape. Clamp member 12, being made from an integral steel stamping, need not have an excess of material along shank portion 27 in order to give structural strength. Because of this, hinge portion 29 can be bent inwardly so as to put the center line of the hinge inboard, i.e., closer to the center of the ring, of the inner circumference of ring portion 13 of clamp member 14. This reduces bending moment forces on hinge shank portion 27 and also wraps the safety latch closer to hook 42, thus eliminating any protruding edges. Shank portion 27 is bent outwardly from ring portion 13 at an angle A, on the order of 1° to 10°, but preferably 5°, in order to allow pivot edge 54 of latch member 10 to clear the hook when latch member 10 is depressed during hook removal.

Safety latches of the general type of the present invention have enjoyed great commercial success both in the past and presently, but especially recently since Federal legislation was enacted making such devices mandatory for safety reasons upon industrial load hooks in heavy industry.

It will be understood that minor changes in the details, materials, and arrangement of parts of the latch member, the clamp member, the securing means, the pivoting means, and the spring of the present invention may be made by those skilled in the art and yet still be within the present inventive principle of which a specific form has been herein selected for illustrations and detailed description without intending to thereby limit the scope of the present invention, as described in the appended claims.

What is claimed is:

1. A safety latch for industrial load hooks comprising:

a latch member comprising a body portion having a pivot end and a hook-engaging end, with finger lugs being carried by said body portion on opposite sides thereof and each projecting away from said body portion, said finger lugs having edges disposed most remote from said pivot end of said body portion that define a substantially obtuse included angle therebetween;

and a deeply indented positioning dimple in the center of the bottom outer surface of said latch member, said dimple comprising means facilitating secured seating of said latch member against lateral movement relative to a load hook surface;

a clamp member, said clamp member being of a one-piece sheet metal construction and comprising a ring portion and a shank portion, said shank portion being integral with said ring portion and said shank portion terminating in a hinge portion having its centerline positioned inboard of the inner circumference of the ring portion of said clamp member, said hinge portion terminating in a loop portion curling inboard, wherein said shank portion is inclined outwardly away from said inner circumference of said ring portion of said clamp member at an angle of approximately 5°, such that said pivot end of said latch member clears the body of the hook when said latch member is depressed during hook removal, said shank portion being of a length relative to the length of said latch member such that said ring portion of said clamp member is at a position on the hook no farther interiorly from the throat opening of the hook than said hook-engaging end of said latch member when said latch member is in a hook-engaging position, whereby said ring portion of said clamp member can be positioned close to the throat opening;

means for securing said clamp member to the hook, said securing means comprising a bolt and nut, said bolt passing through respective holes in opposite ends of said ring portion of said clamp member at a point on the hook behind and opposite said shank portion of said clamp member, said opposite ends being in bent relation out of the plane of the ring of said ring portion so as to enable said safety latch to be positioned closer to the throat opening;

means facilitating relative pivoting between said latch member and said clamp member comprising a bolt passing through said loop portion of said hinge portion of said shank portion of said clamp member and the pivot end of said latch member;

and a spring wrapped about said pivoting means having its ends supported against the inner surface of said latch member, said ends terminating at a point no farther than two-thirds of the distance from said pivot end to said hook-engaging end and its middle portion supported against the outer circumference of said clamp member, so as to result in moment arms of said spring of about equal length.

* * * * *